US008082744B2

(12) United States Patent
Hwang et al.

(10) Patent No.: US 8,082,744 B2
(45) Date of Patent: Dec. 27, 2011

(54) METHOD FOR CONTROLLING HOT WATER CIRCULATION SYSTEM ASSOCIATED WITH HEAT PUMP

(75) Inventors: Jin Ha Hwang, Changwon (KR); Jung Il Park, Changwon (KR)

(73) Assignee: LG Electronics Inc., Seoul (KR)

( * ) Notice: Subject to any disclaimer, the term of this patent is extended or adjusted under 35 U.S.C. 154(b) by 536 days.

(21) Appl. No.: 12/314,024

(22) Filed: Dec. 2, 2008

(65) Prior Publication Data

US 2010/0024449 A1 Feb. 4, 2010

(30) Foreign Application Priority Data

Aug. 4, 2008 (KR) ..... 10-2008-0076018

(51) Int. Cl.
*F25D 21/00* (2006.01)
*F25D 17/02* (2006.01)

(52) U.S. Cl. ..... 62/150; 62/185; 62/201

(58) Field of Classification Search ..... 62/150, 62/151, 157, 160, 181, 183, 185, 201, 272
See application file for complete search history.

(56) References Cited

FOREIGN PATENT DOCUMENTS

KR 2006011389 A * 2/2006

* cited by examiner

*Primary Examiner* — Marc Norman
(74) *Attorney, Agent, or Firm* — KcKenna Long & Aldridge LLP

(57) ABSTRACT

Disclosed is a method for controlling a hot water circulation system associated with a heat pump. The present invention gives a freezing burst prevention operation function to a water-refrigerant heat-exchanger which performs heat exchange between a refrigerant and water, making it possible to remove a phenomenon that the water-refrigerant heat-exchanger installed out of the space where a user lives is frozen to be damaged.

18 Claims, 7 Drawing Sheets

METHOD FOR CONTROLLING HOT WATER CIRCULATION SYSTEM ASSOCIATED WITH HEAT PUMP

This application claims priority to Republic of Korea Patent Application No. 10-2008-0076018, filed Aug. 4, 2008, which is hereby incorporated by reference in its entirety.

BACKGROUND OF THE INVENTION

1. Field of the Invention

The present invention relates to a method for controlling a freezing burst prevention operation of a hot water supply and heating system associated with a heat pump.

2. Discussion of the Related Art

A hot water supply and heating apparatus associated with a heat pump is an apparatus which is combined with a heat pump cycle and a hot water circulation unit and performs heat-exchange between water and refrigerant discharged from a compressor which constitutes a heat pump refrigerant circuit to perform a hot water supply and a floor heating.

In a conventional system, a pipe for water flowing along a closed cycle for heating is separated from that for supplying hot water, and heat exchange is performed at each different spot of the pipe on the outlet side of the compressor of the heat pump refrigerant circuit. That is, in the conventional system, a water-refrigerant heat exchanger for heating and a water-refrigerant heat exchanger for hot water supply are separate.

In the conventional system, water supplied for hot water supply performs heat-exchange with the refrigerant, while passing through the water-refrigerant heat exchanger for hot water supply, and is then directly discharged.

In the conventional hot water supply and heating apparatus associated with the heat pump, there has been no safety apparatus which prevents freezing of a water-refrigerant heat-exchanger provided in an indoor unit. The water-refrigerant heat-exchanger generally uses a plate-type heat-exchanger performing heat exchange between water and a refrigerant. However, if water flowing along the inside of the plate-type heat-exchanger is frozen, the volume of water is expanded. The plate-type heat-exchanger may be damaged due to the volume expansion occurred during the freezing process. If the plate-type heat-exchanger is damaged, water is mixed with the refrigerant and the mixture of the water and refrigerant is flowed into a component of an outdoor unit, in particular, into a compressor, thereby causing damage to the compressor.

Furthermore, the plate-type heat-exchanger is more expensive than a fin-type heat-exchanger, causing a high replacement cost when the plate-type heat-exchanger is damaged.

SUMMARY OF THE INVENTION

Accordingly, the present invention is directed to a refrigerator that substantially obviates one or more problems due to limitations and disadvantages of the related art.

An object of the present invention is to provide a hot water circulation system associated with a heat pump which prevents a water-refrigerant heat-exchanger from being damaged, as water inside the water-refrigerant heat-exchanger is frozen while the system stops its driving or is driven in an outing mode.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with an embodiment of the present invention, there is provided a method for controlling a hot water circulation system associated with a heat pump, the hot water circulation system associated with a heat pump comprising an outdoor unit including a compressor, an outdoor heat-exchanger, and an expansion part, and performing a heat pump refrigerant cycle; an indoor unit including a water-refrigerant heat-exchanger which performs heat exchange between a refrigerant discharged from the compressor and water, and a water pump which circulates water compulsorily; and a hot water circulation unit receives heat from the heated water discharged from the indoor unit to perform hot water supply or heating, wherein the system is controlled such that when the water-refrigerant heat-exchanger is frozen or is right before frozen, a freezing burst prevention operation is performed.

In accordance with another embodiment of the present invention, there is provided a method for controlling a hot water-refrigerant heat-exchanger circulation system associated with a heat pump, the hot water circulation system associated with a heat pump comprising an outdoor unit including a compressor, an outdoor heat-exchanger, and an expansion part, and performing a heat pump refrigerant cycle; an indoor unit including a water-refrigerant heat-exchanger which performs heat exchange between a refrigerant discharged from the compressor and water, and a water pump which circulates water compulsorily; at least one temperature sensor which detects a temperature of space where the indoor unit is installed or a water temperature inside the water-refrigerant heat-exchanger; and a hot water circulation unit receives heat from the heated water discharged from the indoor unit to perform hot water supply or heating, wherein the method comprises: detecting an indoor temperature or a water temperature by the temperature sensor; checking a driving state of the system by a control unit; and receiving a freezing burst prevention operation command from the control unit, when the temperature detected by the temperature sensor is below a set temperature for a freezing burst prevention operation.

With the method for controlling the hot water circulation system associated with the heat pump having the configuration as described above, when an inside of a water-refrigerant heat-exchanger is frozen as the system stops driving or is in an outing mode operation for a long time in winter, the system allows the freezing burst prevention operation to be performed automatically, making it possible to prevent the water-refrigerant heat-exchanger from being damaged.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, the exemplary embodiments of the present invention will be described in more detail with reference to the accompanying drawings.

Figure 1:
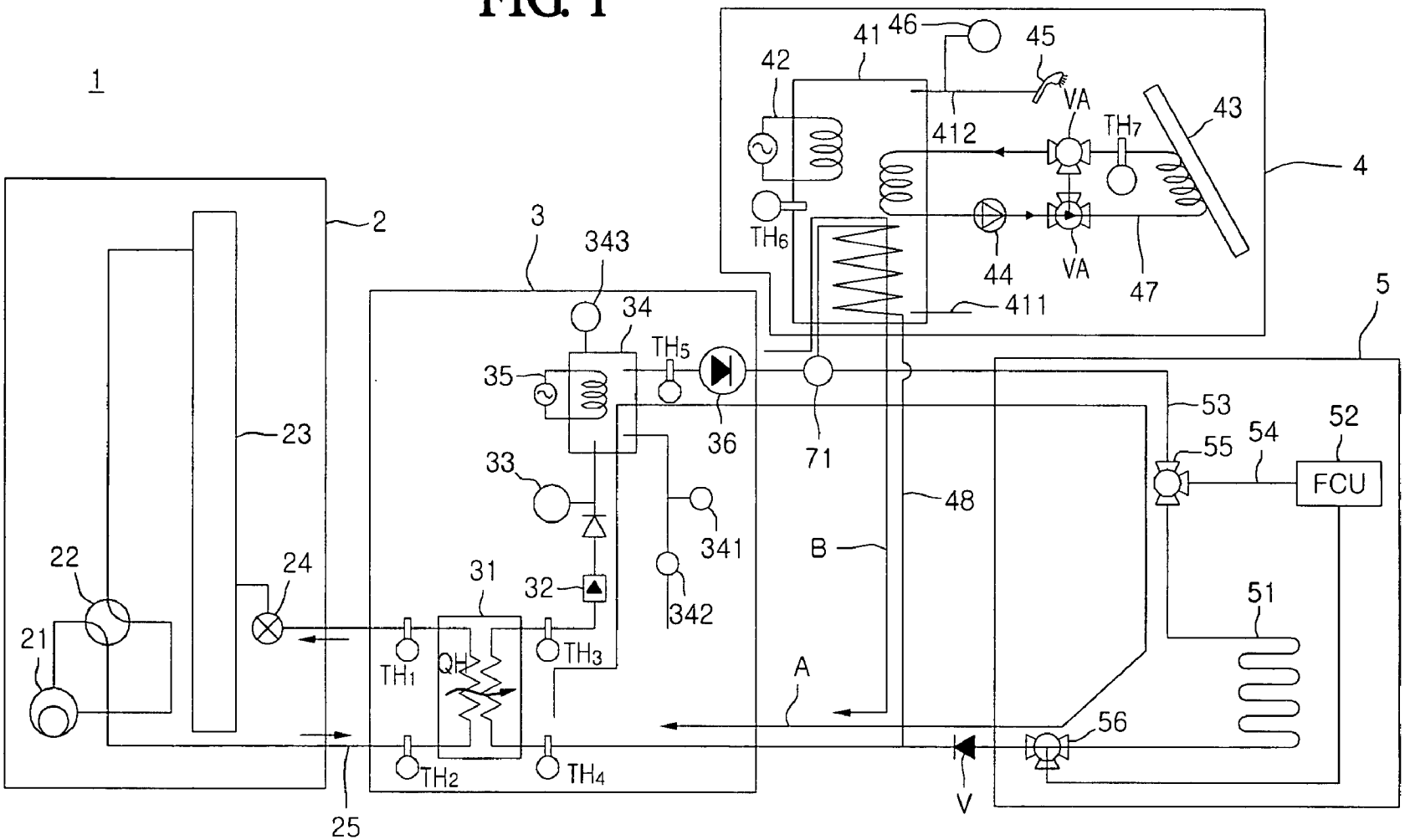
FIG. 1 is a view showing a hot water circulation system associated with a heat pump according to an embodiment of the present invention.
Figure 2:
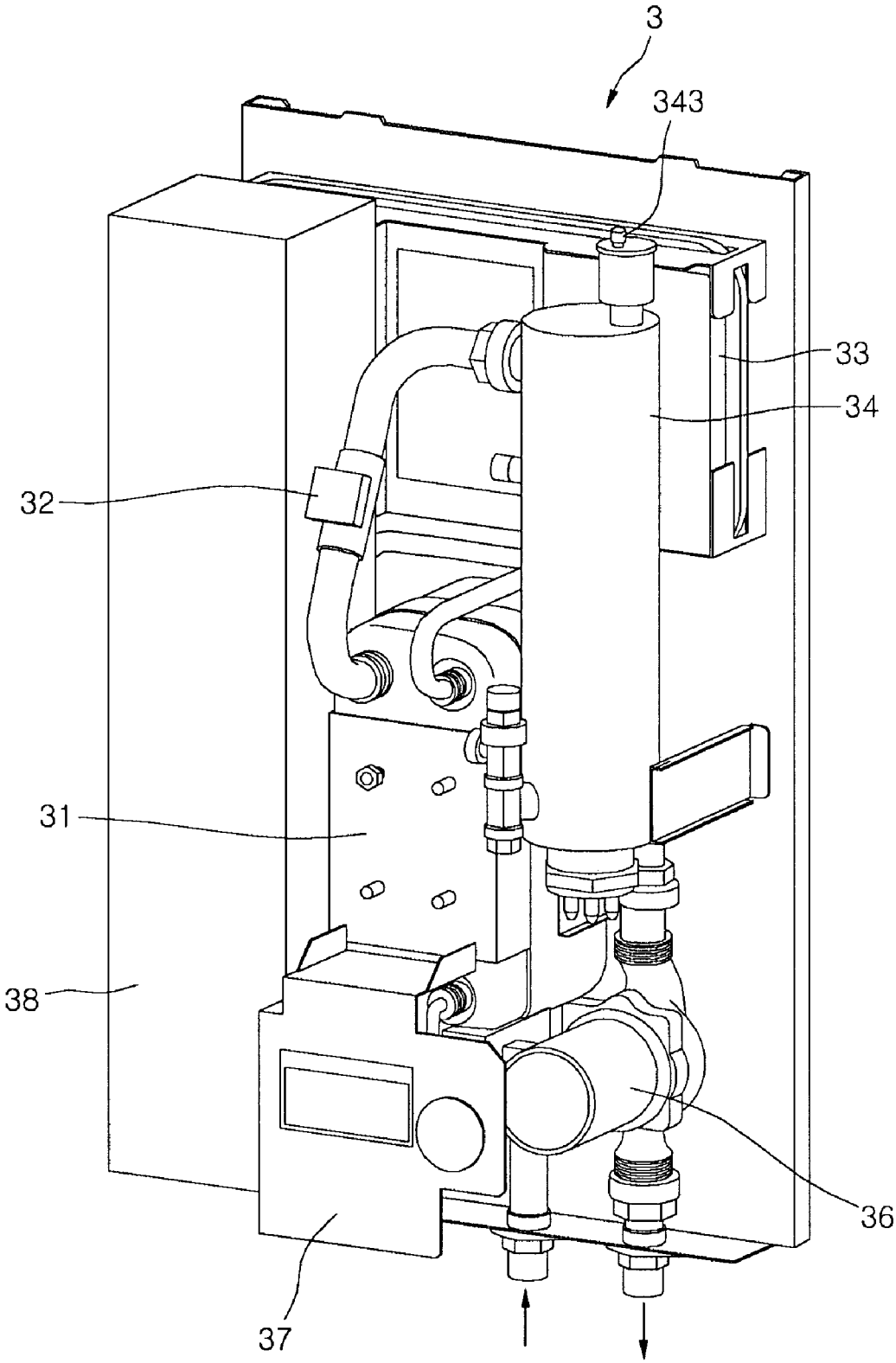
FIG. 2 is a perspective view showing a configuration of an indoor unit which constitutes the hot water circulation system associated with the heat pump.

FIG. 1 is a view showing a hot water circulation system associated with a heat pump according to a first embodiment of the present invention, and FIG. 2 is a perspective view showing a configuration of an indoor unit which constitutes the hot water circulation system associated with the heat pump.

Referring to FIGS. 1 and 2, the hot water circulation system associated with a heat pump 1 includes an outdoor unit 2 in which a heat pump refrigerant cycle is included, an indoor unit 3 which heats water by performing heat-exchange with a refrigerant whose phase is changed along the heat pump refrigerant cycle, a hot water supply unit 4 which is connected heat-exchangeably to a portion of the indoor unit 3 to supply hot water, and a heating unit which consists of a water pipe extended from the indoor unit 3.

More specifically, the heat pump refrigerant cycle includes a compressor 21 which compresses a refrigerant at high temperature and at high pressure, a four-way valve 22 which controls a flow direction of the refrigerant discharged from the compressor 21, a water-refrigerant heat exchanger 31 which performs heat exchange between the high-temperature and high-pressure refrigerant which has passed through the four-way valve 220 and water flowing along a water pipe of the indoor unit 3, an expansion part 24 which expands the refrigerant which has passed through the water-refrigerant heat exchanger 31 at low temperature and at low pressure, and an outdoor heat-exchanger 23 which performs heat-exchange between the refrigerant which has passed through the expansion part and outdoor air. These components are connected to each other through a refrigerant pipe 25 to form a closed cycle. The outdoor unit 2 includes the compressor 21, the four-way valve 22, the expansion unit 24, and the outdoor heat-exchanger 23. When the outdoor unit 2 is operated in a cooling mode, the outdoor heat-exchanger 23 functions as a compressor, and when the outdoor unit 2 is operated in a heating mode, the outdoor heat-exchanger 23 functions as an evaporator. Respective temperature sensors TH1, TH2 may be mounted on refrigerant pipes on inlet and outlet sides of the water-refrigerant heat-exchanger 31.

Hereinafter, the present invention will be described by limiting the hot water circulation system associated with a heat pump 1 to be operated in a heating mode, excepting for the case when the hot water circulation system associated with a heat pump 1 is operated in a defrosting operation.

The indoor unit 3 includes the water-refrigerant heat-exchanger 31, a flow switch which is mounted on the water pipe extended to an outlet side of the water-refrigerant heat-exchanger 31 to detect the flow of water, an expansion tank 33 which is branched at a certain spot spaced from the flow switch 32 in the flow direction of water, a water collection tank 34 to which an end of the water pipe extended from the outlet side of the water-refrigerant heat-exchanger 31 is inserted and an auxiliary heater 35 is provided therein, and a water pump 36 which is provided at a certain spot of the water pipe on the outlet side of the water collection tank 34.

More specifically, the water-refrigerant heat-exchanger 31 is a portion where the heat-exchange is performed between the refrigerant flowing along the heat pump refrigerant cycle and water flowing along the water pipe, and a plate-type heat-exchanger may be applied to the water-refrigerant heat-exchanger 31. In the water-refrigerant heat-exchanger 31, heat QH is transferred from the high-temperature high-pressure gas refrigerant passing through the compressor 21 to the water flowing along the water pipe. The water flowing into the water-refrigerant heat-exchanger 31 is tepid through the hot water supply process or the heating process. Respective temperature sensors TH3, TH4 may be mounted on water pipes on inlet and outlet sides of the water-refrigerant heat-exchanger 31.

When the volume of water heated by passing through the water-refrigerant heat-exchanger 31 is expanded exceeding appropriated levels, the expansion tank 33 functions as a buffer absorbing the overexpanded water. Diaphragms are included inside the expansion tank 33 to move in response to the change of the volume of water. The inside of the expansion tank 33 is filled with nitrogen gas.

The water collection tank 34 is a container where the water passing through the water-refrigerant heat-exchanger 31 is collected. An auxiliary heater 35 is mounted to the inside of the water collection tank 34 to be selectively operated, when the quantity of heat sucked through the defrosting operation process or the water-refrigerant heat-exchanger 31 does not reach the quantity of heat requested. An air vent 343 is formed on the upper side of the water collection tank 34 to allow air overheated in the water collection tank 34 to be exhausted. A pressure gage 341 and a relief valve 342 are provided on one side of the water collection tank 34 to enable the pressure inside the water collection tank 35 to be controlled appropriately. For example, when the water pressure inside the water collection tank 35 indicated by the pressure gage 341 is excessively high, the relief valve 342 is opened to ensure that the pressure inside the tank can be controlled appropriately. A temperature sensor TH5 which measures a water temperature may also be mounted on one side of the water collection tank 34.

Also, the water pump 36 pumps water discharged through the water pipe extended from the outlet side of the water collection tank 34 to supply the water to a hot water supply unit 4 and a heating unit 5.

Also, a control box 38 in which various electric components are stored is mounted on one side of the inside of the indoor unit 3, and a control panel 37 is provided on a front surface of the indoor unit 3. More specifically, the control panel 37 may include a display unit such as a LCD panel, and various input buttons. A user may check operation information such as an operation condition of the indoor unit 3 or a water temperature passing through the indoor unit 3 and other menu, etc., using the display unit.

The hot water supply unit 4 is a portion where water used for the user in washing his or her face or washing the dishes is heated and supplied.

More specifically, a channel switching valve 71 which controls the flow direction of water is provided at a certain spot spaced from the water pump 36 in the flow direction of water. The channel switching valve 71 may be a three-way valve which allows the water pumped by the water pump 36 to be flowed to the hot water supply unit 4 or the heating unit 5. A hot water supply pipe 48 extended to the hot water supply unit and a heating pipe 53 extended to the heating unit 5 are thus connected to the outlet side of the channel switching valve 71, respectively. The water pumped by the water pump 36 is selectively flowed to any one of the hot water supply pipe 48 and heating pipe 53 according to the control of the channel switching valve 71.

The hot water supply unit 4 includes a hot water supply tank 41 in which water supplied from the outside of the hot water supply unit 4 is stored and heated, and an auxiliary heater 42 provided inside the hot water supply tank 41. An auxiliary heat source which supplies heat to the hot water supply tank 41 may further be included according to the installation form of the hot water supply unit 4. A heat storage tank 43 using a solar cell panel may be suggested as the auxiliary heat source. An inlet part 411 into which cold water is flowed and an outlet part 412 through which heated water is discharged are provided on one side of the hot water supply unit 4.

More specifically, a portion of the hot water supply pipe extended from the channel switching valve 71 is inserted into the hot water supply tank 41 to heat water stored inside the hot water supply tank 41. In other words, heat is transferred from high-temperature water flowing along the inside of the hot water supply pipe 48 to water stored in the hot water supply tank 41. In a certain case, additional heat may also be supplied by operating the auxiliary heater 42 and auxiliary heat source. The auxiliary heater 42 and auxiliary heat source may be operated when water must be heated in a short time, for example, when a user needs a considerable amount of hot water in order to take a shower. A temperature sensor which detects a water temperature may be mounted on one side of the hot water supply tank 41.

A hot water discharging apparatus such as a shower 45 or a home appliance such as a humidity 46 may be connected to the outlet part 412 according to embodiments. When the heat storage tank 43 using the solar cell panel is used as the auxiliary heat source, an auxiliary pipe 47 extended from the heat storage tank 43 may be inserted into the inside of the hot water supply tank 41. An auxiliary pump 44 which controls flow velocity inside a closed cycle of the auxiliary pipe and a direction switching valve VA which controls the direction of water flow inside the auxiliary pipe 47 may be mounted on the auxiliary pipe 47. A temperature sensor TH7 which measures a water temperature may also be mounted on any one side of the auxiliary pipe 47.

The structure of the auxiliary heat source such as the heat storage tank using the solar cell panel is not limited to the embodiment proposed above, but the auxiliary heat source may be mounted on other positions, having diverse forms.

Meanwhile, the heating unit 5 includes a floor heating unit 51 formed by laying a portion of the heating pipe 53 under an indoor floor, and an air heating unit 52 branched from any spot of the heating pipe 53 to be connected to the floor heating unit 51 in parallel.

More specifically, the floor heating unit 51 may be laid under the indoor floor in a meander line form, as shown in FIG. 1. The air heating unit 52 may be a fan coil unit or a radiator. In the air heating unit 52, a portion of an air heating pipe 54 branched from the heating pipe 53 is provided as a heat-exchange means. On the spots branched from the air heating pipe 54, channel switching valves 55, 56 such as a three-way valve are installed to allow the refrigerant flowing along the heating pipe 53 to be flowed onto the floor heating unit 51 and the air heating unit 52, or to be flowed onto only any one of the floor heating unit 51 and the air heating unit 52.

An end of the hot water supply pipe 48 extended from the channel switching valve 71 is combined at the spot spaced from an outlet end of the air heating pipe 54 in the flow direction of water. In a hot water supply mode, the water flowing along the hot water pipe 48 is thus put together into the heating pipe 53 again and is then flowed into the water-refrigerant heat-exchanger 31.

Here, a check valve V is installed on a spot required to cut off a counter flow, such as a spot where the heating pipe 48 and the heating pipe 53 are combined, making it possible to prevent the counter flow of water. In this regard, check valves can be installed on an outlet end of the air heating pipe 54 and an outlet end of the floor heating unit 51, respectively, instead of the method that the channel switching valve 56 is installed on the outlet ends.

Hereinafter, the flow of water occurring in the hot water circulation system associated with the heat pump will be described for each operation mode.

In the hot water supply mode, the flow of water is controlled by the channel switching valve 71 to be flowed onto the hot water supply pipe 48. Therefore, water circulates along a closed cycle B in which a water-refrigerant heat-exchanger 31, a water collection tank 34, a water pump 36, a channel switching valve 71 and a hot water supply pipe 48 are connected. During such a circulation process, cold water flowed into an inlet part 411 of the hot water supply tank 41 is heated and then discharged into the outside of the water supply tank 41 through an outlet part 412 thereof, thereby being supplied to a user.

In the heating mode, the flow of water is controlled by the channel switching valve 71 to be flowed onto the heating pipe 53. Therefore, water circulates along a closed cycle A in which a water-refrigerant heat-exchanger 31, a water collection tank 34, a water pump 36, a channel switching valve 71 and a hot water supply pipe 48 are connected. The water flowing along the heating pipe 53 thus flows onto the air heating unit 52 or the floor heating unit 51.

Figure 3:
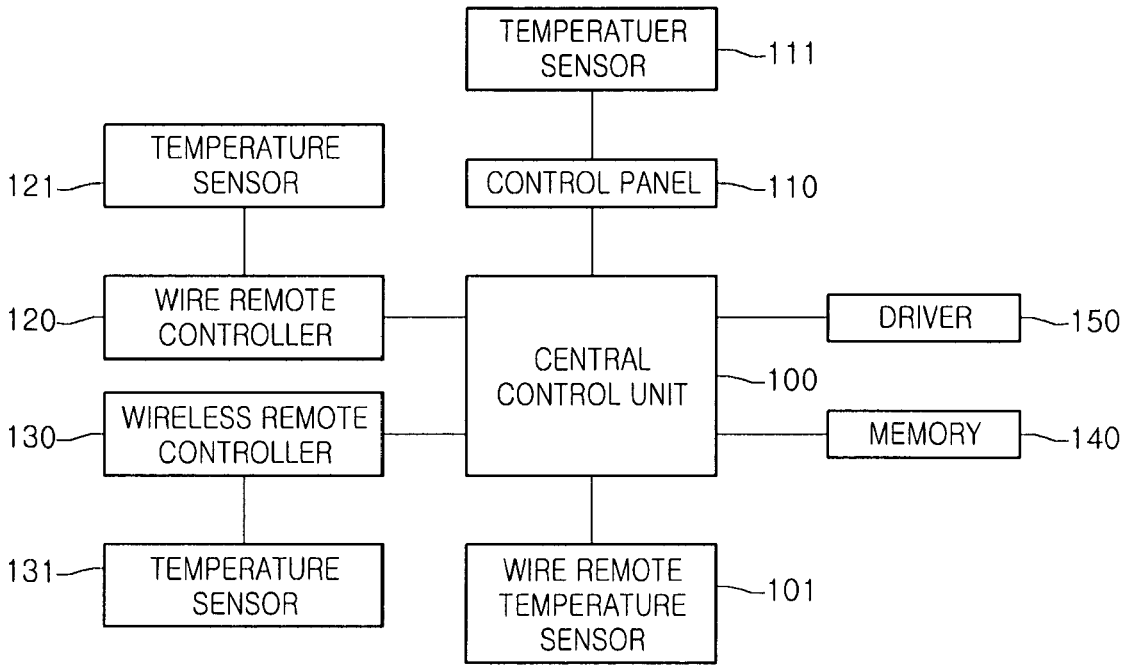
FIG. 3 is a block diagram showing a control configuration of a hot water circulation system associated with a heat pump according to an embodiment of the present invention.

FIG. 3 is a block diagram showing a control configuration of a hot water circulation system associated with a heat pump according to an embodiment of the present invention.

Referring to FIG. 3, the hot water circulation system associated with the heat pump according to the embodiment of the present invention includes a central control unit 100, a control panel unit 110 attached to a front surface of the indoor unit 3, a wire remote controller 120 extended by wire from the control panel unit 110 of the indoor unit 3 and attached to a wall surface of the place on which the indoor unit 3 is installed or a room where a user lives, a wireless remote controller 130 performing the same function as the control panel unit 110 or the wire remote controller 120, a driver 150 driven according to a control command of the central control unit 100, and a memory in which various data and operation information are stored.

More specifically, the central control unit 100 may be provided on a control box 38 mounted inside the indoor unit 3. A control panel 37 mounted on a front surface of the indoor unit 3 may correspond to the control panel unit 110. The driver 150 may be an indoor unit component and/or an outdoor unit component controlled by the central control unit 100. For example, a water pump 36 and an auxiliary heater 35 provided in the indoor unit 3 may correspond to the driver 150, and a compressor 21, an expansion part 24, and a four-way valve provided in the outdoor unit 2 may also correspond to the driver 150.

Meanwhile, on the control panel unit 110, wire remote controller 120, and wireless remote controller 130, temperature sensors 111, 121, 131 may be mounted, respectively, the temperature sensors 111, 121, 131 detecting an air temperature in the space where the indoor unit 3 is installed, or where the wire remote controller 120 and wireless remote controller 130 are put.

Also, a wire remote temperature sensor 101 may further be provided, the wire remote temperature sensor 101 connected by wire directly to the central control unit 100 and mounted in the room where a user lives.

Hereinafter, it will be described a freezing burst prevention operation control method using at least one of temperature sensors 101, 111, 121, 131 which detect a temperature of air or at least one of temperature sensors TH1 to TH5 provided on a water pipe constituting the indoor unit 3 and a hot water circulation unit and detecting a temperature of water. Here, the hot water circulation unit refers to the hot water supply unit 4 and heating unit 5.

Figure 4:
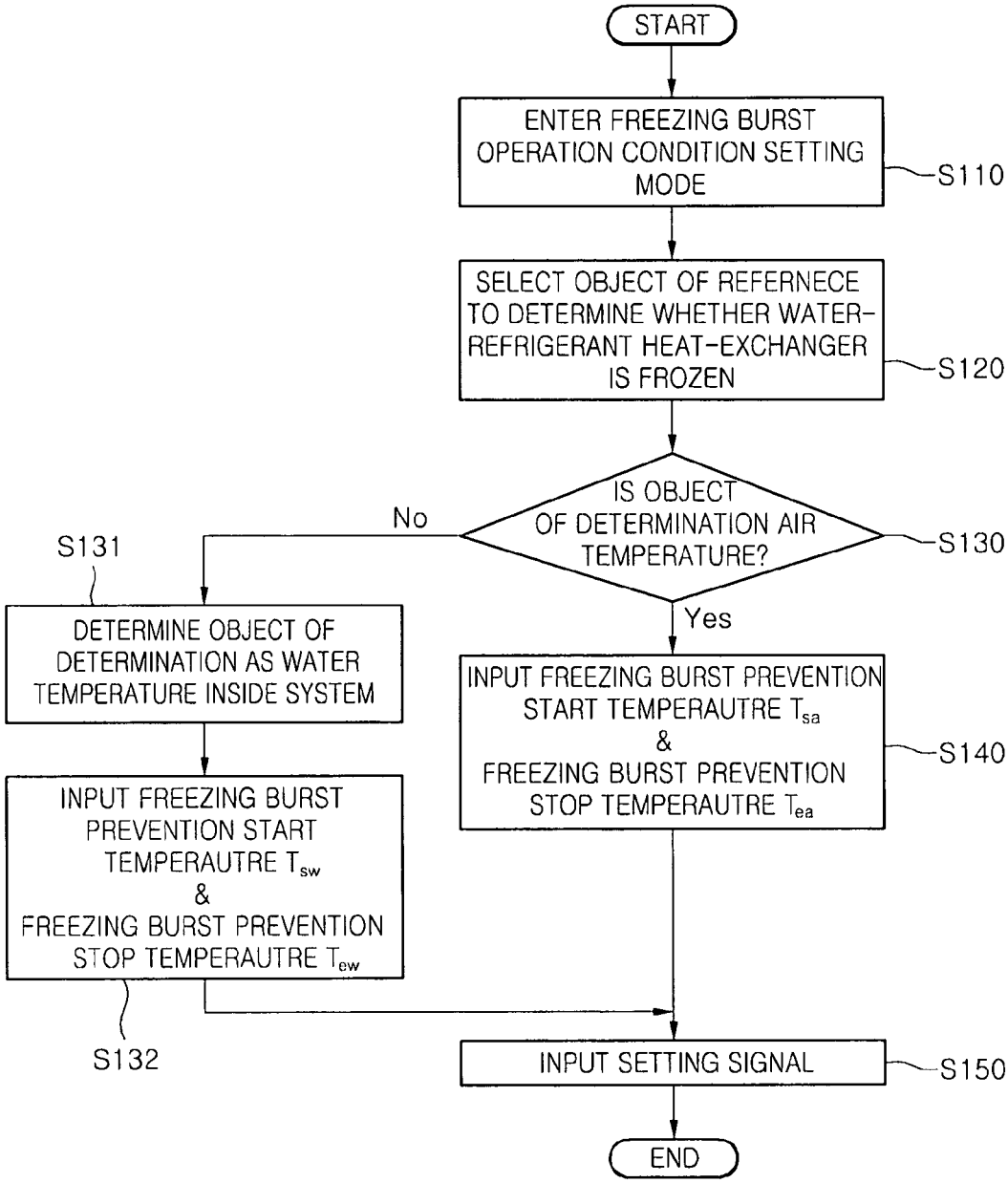
FIG. 4 is a flowchart showing a method for setting a freezing burst prevention operation condition so that a freezing burst prevention operation is performed in a hot water circulation system associated with a heat pump according to an embodiment of the present invention.

FIG. 4 is a flowchart showing a method for setting a freezing burst prevention operation condition so that a freezing burst prevention operation is performed in a hot water circulation system associated with a heat pump according to an embodiment of the present invention.

Referring to FIG. 4, the freezing burst prevention operation condition described above may be considered as a process that a manufacturer operates a product while the product is released or an installer operates a product after the product is installed. This is the reason that since the freezing point of water is almost the same regardless of installation regions, the freezing burst prevention operation condition will do, even though a user doe not set the condition individually. The freezing burst prevention operation condition is not limited thereto, but the user may also set the condition.

First, a manufacturer, an installer, or a user sets a freezing burst prevention operation condition setting mode using the control panel unit 110, the wire remote controller 120, or the wireless remote controller 130. The central control unit 100 then receives a signal for the freezing burst prevention operation condition setting mode to enter a setting mode (S110). The object of reference for determining whether a water-refrigerant heat-exchanger 31 is frozen is selected by the user, and the selected signal is input to the central control unit 100 (S120).

More specifically, the object of reference for determining whether a water-refrigerant heat-exchanger 31 is frozen becomes air or water. That is, whether the water-refrigerant heat-exchanger 31 is frozen is determined by selecting any one of an indoor temperature in any one of the space where the indoor unit 3 is installed and the space where the user lives, and water inside the water-refrigerant heat-exchanger 31.

The central control unit 100 then determines whether the object of reference is air temperature (S130), and allows a signal to be displayed on the display unit, if it is determined that the air temperature is selected, the signal waiting for inputting of a freezing burst prevention operation start temperature $T_{sa}$ and a freezing burst prevention operation stop temperature $T_{sa}$. The freezing burst prevention operation start temperature $T_{sa}$ and the freezing burst prevention operation stop temperature $T_{sa}$ are then input by the user in turn (S140).

To the contrary, if it is determined that the object of reference is not air temperature, the object of reference may be determined automatically as water temperature inside the system (S131). Continuously, a signal is displayed on the display unit, the signal waiting for inputting of a freezing burst prevention operation start temperature $T_{sa}$ and a freezing burst prevention operation stop temperature $T_{sa}$. The freezing burst prevention operation start temperature $T_{sa}$ and the freezing burst prevention operation stop temperature $T_{sa}$ are then input by the user in turn (S132).

Meanwhile, if the user completes the input of temperature, a setting signal which completes the setting by the input temperature is input (S150). The method for inputting the setting signal may be an operation that the user presses a separate setting button provided on the control panel during the setting time, or an operation that the user presses a button indicating the freezing burst prevention operation setting mode once more.

Figure 5:
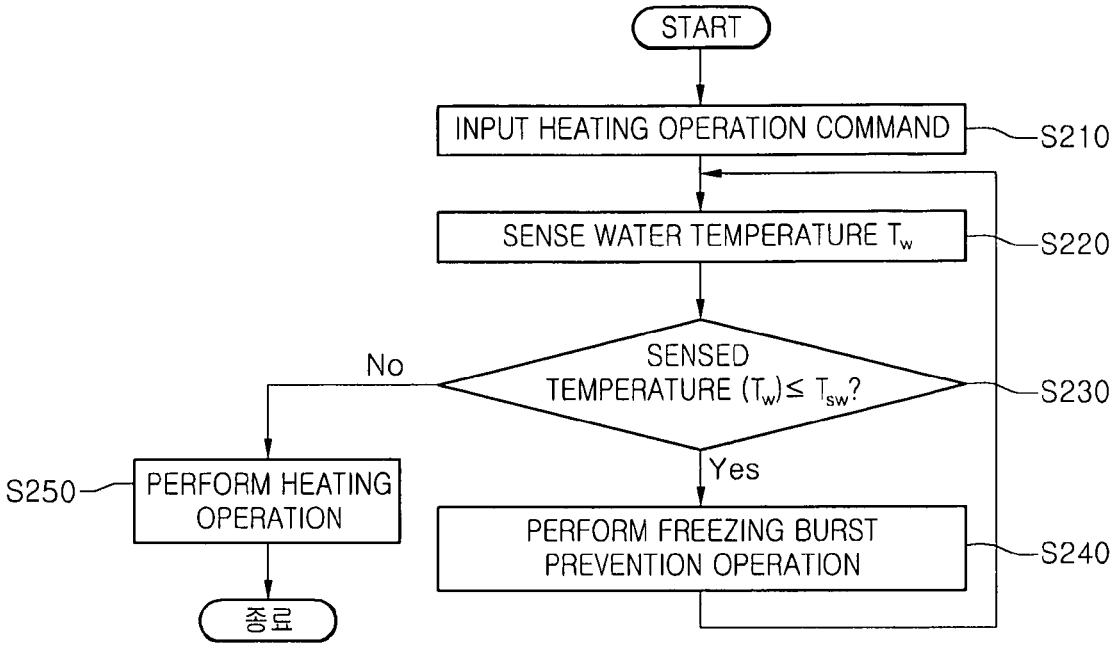
FIG. 5 is a flowchart showing a freezing burst prevention operation method according to a first embodiment of the present invention.

FIG. 5 is a flowchart showing a freezing burst prevention operation method according to a first embodiment of the present invention.

Referring to FIG. 5, in the present embodiment, when a heating operation command is input in a state that the system stops driving, the freezing burst prevention operation method will be described. Hereinafter, the present invention will be described by limiting the object of reference for determining whether a water-refrigerant heat-exchanger 31 is frozen to the water temperature within a water pipe. The same control method is applied to the case when the object of reference is the indoor temperature, and thus it will not be repeated.

More specifically, if the system remains a driving stop condition but a user inputs a heating operation command to the system (S210), the system starts driving.

Before the system starts driving, the water temperature Tw within the water pipe is detected by a temperature sensor (S220). Here, the water temperature Tw may be a temperature detected by a temperature sensor TH1 or TH2 mounted on an inlet side or an outlet side of the water-refrigerant heat-exchanger 31. The detected temperature is then transferred to the central control unit 220, and the central control unit 220 determines whether the detected temperature Tw is lower than a freezing burst prevention operation start temperature Tsw (S230). The freezing burst prevention operation start temperature Tsw may be a temperature that is equivalent to or somewhat higher than a temperature that water starts freezing.

Meanwhile, if the detected temperature is determined to be lower than the freezing temperature, an freezing burst prevention operation is performed (S240), and if the detected temperature is determined to be higher than the freezing temperature, a heating operation is directly performed (S250).

Here, the freezing burst prevention operation refers to an operation that the outdoor unit 2 is driven by a heat pump refrigerant cycle and an auxiliary heater 35 mounted to a water collection tank 34 in the indoor unit 3 is selectively operated. The water pump 36 is not driven, so water circulation is not performed.

In other words, heat is transferred from a high-temperature high-pressure refrigerant passing through a compressor to a water-refrigerant heat-exchanger 31, so water stored in the water-refrigerant heat-exchanger 31 thaws. The water may also be pre-heated before the water pump 36 is driven by operating the auxiliary heater 35. Then, the time when it takes for the inside of the water pipe after a heating operation is performed to reach a temperature for performing a normal heating operation may be shortened.

When the heating operation 250 starts, the water pump 36 operates together with the driving of the outdoor unit, so water flows onto the heating unit 5. The water inside the water pipe circulates along a closed cycle connecting the indoor unit 3 to the heating unit and receives heat from the water-refrigerant heat-exchanger 31 to be heated.

Figure 6:
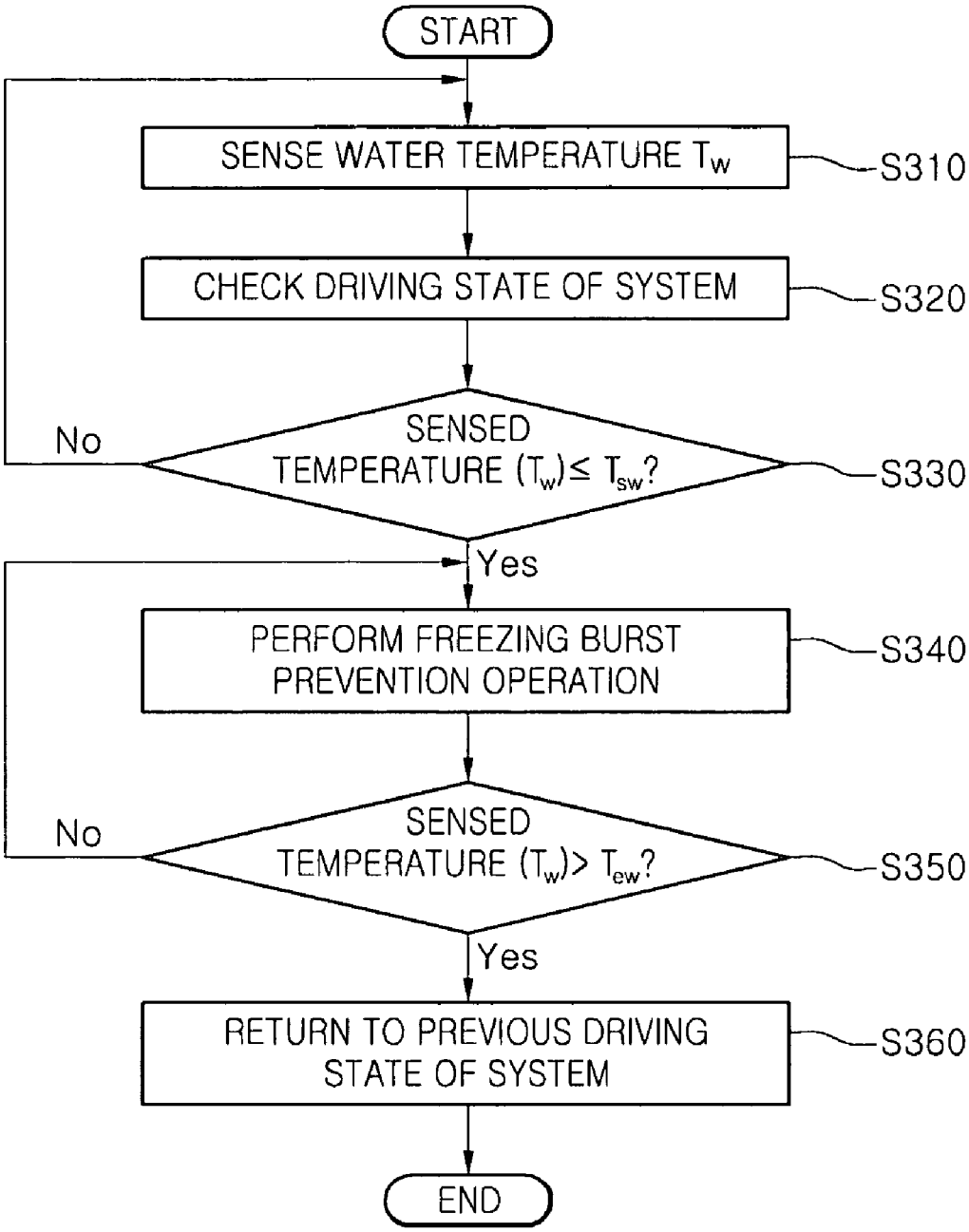
FIG. 6 is a flowchart showing a freezing burst prevention operation control method according to a second embodiment of the present invention.

FIG. 6 is a flowchart showing a freezing burst prevention operation control method according to a second embodiment of the present invention.

Referring to FIG. 6, in the present embodiment, the freezing burst prevention operation is performed automatically when the system is in a driving stop condition for a long time or in an outing mode set by a user. As preconditions, it is assumed that the system of the present invention remains a power-on condition and an outdoor unit and an indoor unit stop driving. Hereinafter, the present invention will be described by limiting the object of reference to the water temperature within a water pipe, as shown in FIG. 5.

More specifically, in the central control unit 100, a temperature sensor TH operates at a predetermined time interval to detect the water temperature (S310). In the central control unit 100, the driving state of the system is checked periodically (S320). Here, the driving state of the system may be any one of states when an outdoor unit 2 and an indoor unit 3 stop driving, the system is operated in an outing mode set by a user, and a normal heating operation is performed.

Meanwhile, in the central control unit 100, it is determined whether a water temperature Tw detected by a temperature sensor is lower than a freezing burst prevention operation start temperature Tsw, that is, a freezing temperature (S330). When it is determined that the detected temperature Tw reaches the freezing burst prevention operation start temperature, a freezing burst prevention operation is performed (S340). Since the freezing burst prevention operation is the same as that shown in FIG. 5, and thus, it will not be repeated. The water temperature is detected in real time while the freezing burst prevention operation is performed. It is determined whether the detected water temperature Tw reaches a freezing burst prevention operation stop temperature $T_{ew}$ (S350).

More specifically, if the water temperature Tw detected during the freezing burst prevention operation is determined to be equivalent to or somewhat higher than the freezing burst prevention operation stop temperature $T_{ew}$, the system returns to a previous driving state of the system (S360).

In contrast, if the detected temperature Ta is higher than the freezing burst prevention operation start temperature, a separate driving command is not transferred but an operation to detect an indoor temperature (S310) is performed repeatedly.

In the present embodiment, differently from the first embodiment where the heating operation is performed directly after the water temperature within the water pipe exceeds the freezing burst prevention operation start temperature, the freezing burst prevention operation starts and continues until the water temperature reaches a predetermined freezing burst prevention operation stop temperature.

More specifically, in the first embodiment where a heating operation command is input, the heating operation is performed continuously after the freezing state of the water-refrigerant heat-exchanger is released, such that it is highly possible that the water-refrigerant heat-exchanger will not be frozen.

However, in the second embodiment, the system is returned to a previous operation mode after the freezing burst prevention operation is completed, such that it is highly possible that the water-refrigerant heat-exchanger is frozen again within a short time. For example, when the previous operation mode is a driving stop mode or an outing operation mode, if the system is returned to the previous operation mode right after the freezing state is released as shown in the first embodiment, it is highly possible that the water-refrigerant heat-exchanger is frozen again. Therefore, with to the present embodiment, the freezing burst operation starts and continues until the water temperature within the water pipe reaches a setting temperature, making it possible to minimize the possibility that the water-refrigerant heat-exchanger is frozen again.

Figure 7:
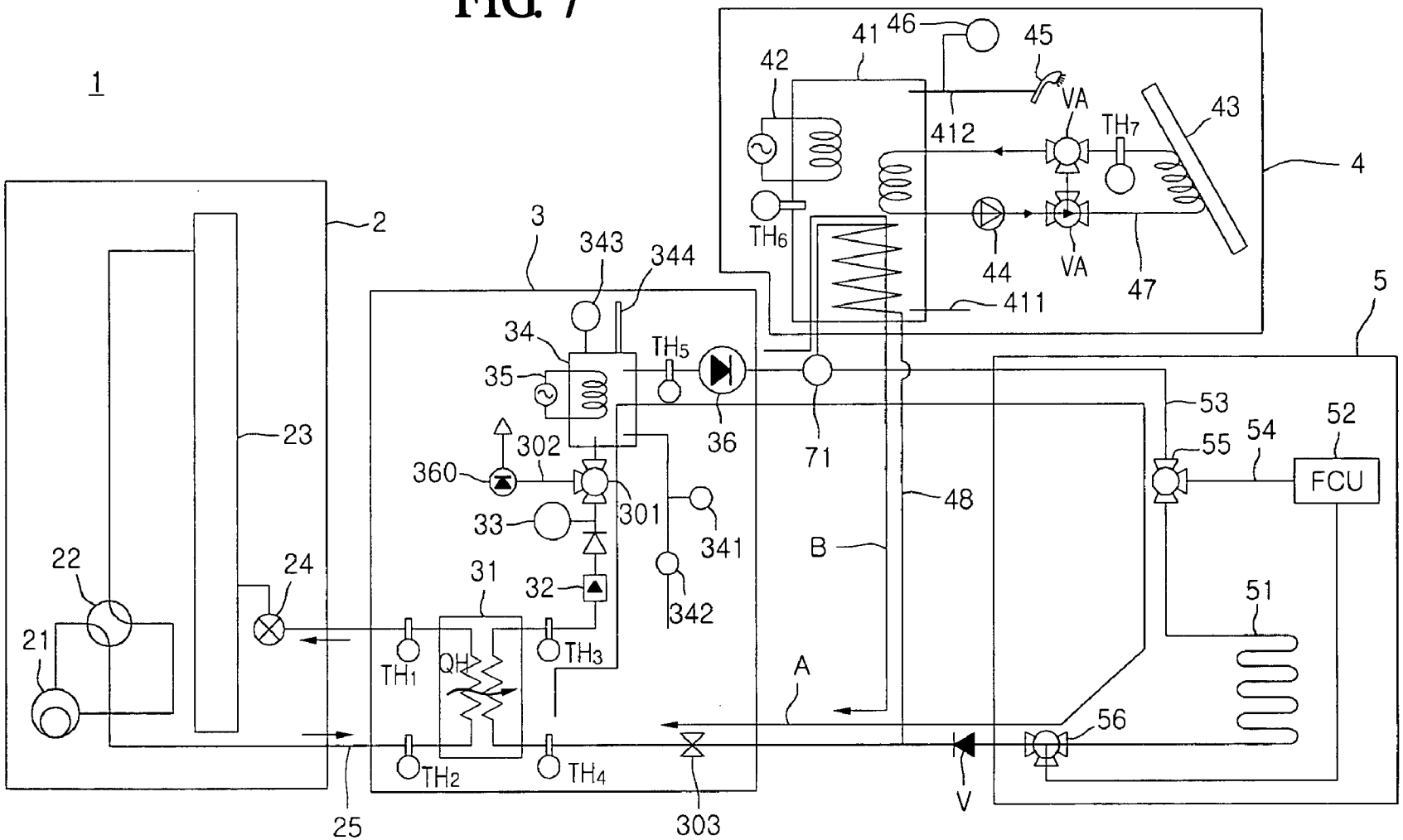
FIG. 7 is a view showing a hot water circulation system associated with a heat pump for preventing freezing according to a third embodiment of the present invention.

FIG. 7 is a view showing a hot water circulation system associated with a heat pump for preventing freezing according to a third embodiment of the present invention.

Referring to FIG. 7, in the third embodiment, in order to prevent freezing of a water-refrigerant heat-exchanger 31, water within a water pipe is discharged in a state that a user is out for a long time or a heating operation stops.

To this end, a drain pipe 302 is branched from a certain spot of the water pipe provided within the indoor unit 3, and a switching valve 301 such as a three-way valve may be mounted on a branched spot of the drain pipe 302. A drain pump 3060 may be mounted on a certain spot of the drain pipe 302.

Also, an opening and shutting valve 303 may be mounted on a certain spot of an inlet side of the water-refrigerant heat-exchanger 31, and a feed hole for supplying water may be formed on a certain spot of the water collection tank 34.

The system has the same configuration as that shown in FIG. 1, excepting for the configuration for the drain as described above, and thus the constituents shared therebetween will not be repeated.

More specifically, the feed hole 344 is formed on an upper surface of the water collection tank 34, and a water works direction connection type that a water pipe entering an indoor is directly connected, or a user supply type that a user directly supplies water may be applied to the feed hole 344.

For example, when the water works direction connection type is applied, if a heating operation command is input after water within a water pipe is removed, water supply may be performed automatically through the feed hole 344 by the control unit 100.

Meanwhile, a menu button which removes water within the water pipe may be provided on at least one side of a control panel 37 and wire/wireless remote controllers of the indoor unit 3.

Hereinafter, the menu for drain is referred to as a "freezing burst prevention drain mode".

More specifically, if a user inputs a freezing burst prevention drain mode through a button input, the operation of the opening and shutting valve 303, switching valve 301 and drain pump 360 may be controlled by the control unit 100.

Also, the following two methods may be applied as a method to drain water inside the water pipe. In other words, a method to drain water only inside the water-refrigerant heat-exchanger 31, and a method to drain all water inside the water pipe connected through an outlet of the water pump 36, the water supply unit 4, the heating unit 5, and an outlet of the water collection tank 34 may be applied. Therefore, the freezing burst prevention drain mode includes a menu capable of selecting a drain method.

For example, the system may be programmed so that the freezing burst prevention drain mode selection and the drain method proposed accordingly are selected together using the number of pressing the input button and a time when the input button continues its pressed state. Alternatively, a separate button for selecting a drain method may also be provided.

Hereinafter, assuming that the freezing burst prevention drain mode is selected, a control method performed according to the drain method selected by a user will be described.

First, the present embodiment will describe the case when the method to drain water only inside the water-refrigerant heat-exchanger 31 is selected.

When the method to drain water only inside the water-refrigerant heat-exchanger 31 is selected, the opening and hutting valve 303 is closed and the switching valve 301 is controlled to be opened toward the drain pipe 302. When the drain pump 360 operates, water inside the water pipe that reaches an inlet side of the switching valve 301 from an outlet side of the opening and shutting valve 303 and reaches, passing through the water-refrigerant heat-exchanger 31, is drained to the outside along the drain pipe 302. During the drain process, the flow of water is detected by the flow switch 32. Therefore, the drain pump 360 is driven while the flow switch maintains an on-state. When the flow switch 32 is turned off, or a predetermined time elapses from the moment that the flow switch 32 is turned off, the drain pump 360 stops driving. Then, water is no longer present inside the water-refrigerant heat-exchanger 31, and a phenomenon that water flows back to the water-refrigerant heat-exchanger 31 is prevented by a check valve provided on an outlet side of the flow switch 32 (see FIG. 7).

Meanwhile, when the method to drain water inside the water pipe connecting the water supply unit 4, heating unit 5 and water-refrigerant heat-exchanger 31 completely is selected, the opening and shutting valve 303 is opened. And, the switching valve 301 is controlled to be opened toward the drain pipe 302. When the drain pump 360 operates, water inside the pipe connected from an outlet side of the water pump 36 to an inlet side of the switching valve 301 is drained to the outside. More specifically, if the drain pump 360 drives, water flowing along the water supply pipe 48 and heating pipe 53 and water inside the water-refrigerant heat-exchanger 31 are completely drained to the outside.

As described above, the present invention can drain water only inside the water-refrigerant heat-exchanger 31 or water inside the system completely according to the drain method, making it possible to reduce risk that the water-refrigerant heat-exchanger 31 is damaged due to a freezing burst even when the system according to the present invention stops driving for a long time or a user is out for a long time.

Meanwhile, when water inside the water pipe or water inside the water-refrigerant heat-exchanger 31 is completely removed by performing a drain operation which prevents freezing, an input of a heating operation driving command will be described. If the heating operation driving command is input, the control unit 100 may control the control panel unit 110 to display a water supply command.

For example, when the feed hole 344 is the water works direction connection type, the control unit 100 allows an opening and shutting valve which opens and shuts the feed hole 344 to be opened, making it possible to feed an amount of water equivalent to water drained automatically.

To the contrary, when the feed hole 344 is the user supply type, the user may feed water directly by opening a lid of the feed hole 344.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a hot water circulation system associated with a heat pump, the hot water circulation system associated with a heat pump comprising an outdoor unit including a compressor, an outdoor heat-exchanger, and an expansion part, and performing a heat pump refrigerant cycle; an indoor unit including a water-refrigerant heat-exchanger which performs heat exchange between a refrigerant discharged from the compressor and water, and a water pump which circulates water compulsorily; and a hot water circulation unit receives heat from the heated water discharged from the indoor unit to perform hot water supply or heating, wherein the system is controlled such that when the water-refrigerant heat-exchanger is frozen or is right before frozen, a freezing burst prevention operation which is a process where the outdoor unit performs a heat pump refrigerant cycle and the water pump maintains a driving stop state is performed.

2. The method as claimed in claim 1, wherein the freezing state of the water-refrigerant heat-exchanger is determined by detecting a water temperature inside the water-refrigerant heat-exchanger.

3. The method as claimed in claim 2, wherein the water temperature is detected by a temperature sensor mounted on an inlet or an outlet of the water-refrigerant heat-exchanger.

4. The method as claimed in claim 1, wherein the freezing state of the water-refrigerant heat-exchanger is determined by detecting an air temperature in the space where the system is installed.

5. The method as claimed in claim 4, wherein the air temperature is detected by any one of a temperature sensor mounted on the indoor unit and the wire or wireless controller and a wire remote temperature sensor extended from the indoor unit.

6. The method as claimed in claim 1, wherein before or after the system is installed, a lowermost temperature for starting the freezing burst prevention operation and/or an uppermost temperature for stopping the freezing burst prevention operation is set.

7. The method as claimed in claim 1, wherein the freezing burst prevention operation includes:

inputting a heating operation command;

detecting the air temperature in the space where the system is installed or the water temperature inside the system; and transferring a freezing burst prevention operation command by a control unit, when the temperature is below a set temperature.

8. The method as claimed in claim 7, wherein when the temperature is above the set temperature, a heating operation is directly performed.

9. The method as claimed in claim 1, wherein during the freezing burst prevention operation, the system is controlled such that an auxiliary heater provided on the indoor unit is enabled to be selectively driven.

10. A method for controlling a hot water-refrigerant heat-exchanger circulation system associated with a heat pump, the hot water circulation system associated with a heat pump comprising an outdoor unit including a compressor, an outdoor heat-exchanger, and an expansion part, and performing a heat pump refrigerant cycle; an indoor unit including a water-refrigerant heat-exchanger which performs heat exchange between a refrigerant discharged from the compressor and water, and a water pump which circulates water compulsorily; at least one temperature sensor which detects a temperature of space where the indoor unit is installed or a water temperature inside the water-refrigerant heat-exchanger; and a hot water circulation unit receives heat from the heated water discharged from the indoor unit to perform hot water supply or heating, wherein the method comprises:

detecting an indoor temperature or a water temperature by the temperature sensor;

checking a driving state of the system by a control unit; and performing a freezing burst prevention based upon an operation command from the control unit, when the temperature detected by the temperature sensor is below a set temperature, wherein the system is controlled such that at least the water in the water-refrigerant heat-exchanger is drained when the freezing burst prevention operation starts.

11. The method as claimed in claim 10, wherein when the temperature detected by the temperature sensor reaches a set temperature for stopping the freezing burst prevention operation after starting the freezing burst prevention operation, the system is controlled such that the freezing burst prevention operation stops.

12. The method as claimed in claim 11, wherein when the freezing burst prevention operation stops, the system is controlled to be returned to its previous driving state.

13. The method as claimed in claim 12, wherein the previous driving state is any one of a system stop state, an outing mode, and a heating operation mode.

14. The method as claimed in claim 11, wherein the system is controlled such that only the outdoor unit is driven until the detected temperature reaches the set temperature for stopping the freezing burst prevention operation.

15. The method as claimed in claim 10, wherein it is determined by a flow switch provided on an outlet side of the water-refrigerant heat-exchanger whether the water in the water-refrigerant heat-exchanger is drained completely.

16. The method as claimed in claim 10, wherein the hot water circulation system associated with a heat pump includes:

an opening and closing valve provided on an inlet side of the water-refrigerant heat-exchanger;

a switching valve provided on an outlet side of the water-refrigerant heat-exchanger;

a drain pipe connected to the switching valve; and a drain pump provided at a predetermined position of the drain pipe, wherein the operation conditions for preventing freezing is satisfied, the driving of the opening and closing valve, switching valve and drain pump is controlled by the control unit.

17. The method as claimed in claim 16, wherein the system is controlled such that when the opening and closing valve is closed, the water only in the water-refrigerant heat-exchanger is drained, and when the opening and closing valve is opened, the water in both the water-refrigerant heat-exchanger and hot water circulation unit is drained completely.

18. The method as claimed in claim 16, wherein the system is controlled such that when a heating operation command is input after the freezing burst prevention operation, water supply process is performed automatically by the control unit.

* * * * *